United States Patent [19]

Wallrafen

[11] 4,027,559

[45] June 7, 1977

[54] DEVICE FOR ACTUATING SCREW-THREADED BOLTS

[75] Inventor: Günter Wallrafen, Erkelenz-Kuckhoven, Germany

[73] Assignee: Maschinen- und Bohrgerate-Fabrik Alfred Wirth & Co., K.G., Erkelenz, Germany

[22] Filed: Aug. 27, 1975

[21] Appl. No.: 608,254

[30] Foreign Application Priority Data

Sept. 6, 1974 Germany ..... 2442798

[52] U.S. Cl. ..... 81/57.38

[51] Int. Cl.² ..... B25B 29/02

[58] Field of Search ..... 81/57.38, 55, 56

[56] References Cited

UNITED STATES PATENTS

| | | | |
|---|---|---|---|
| 1,343,667 | 6/1920 | Evensen | 81/56 |
| 3,015,975 | 1/1962 | Biach | 81/57.38 |
| 3,041,902 | 7/1962 | Wing | 81/56 |
| 3,877,326 | 4/1975 | Kock et al. | 81/57.38 |

*Primary Examiner*—James L. Jones, Jr.

[57] ABSTRACT

Device for actuating screw bolts, one end of which have spanner flats and the other end of which can be screwed into a receptor screw threading to form screw connections on flanges, lids, closures and the like, the device comprising a support member, the bottom end of which can be placed on a base, said support member having at least one opening for receiving at least one screw bolt end, and a spanner element which is retained by the support member or a part associated therewith and can be rotated by means of a motor drive, and can be brought into torque-transmitting connection with the spanner flats of a screw bolt.

14 Claims, 4 Drawing Figures

DEVICE FOR ACTUATING SCREW-THREADED BOLTS

BACKGROUND OF THE INVENTION

The invention relates to a device actuating for screw threaded bolts, having spanner flats at one end and being adapted at the other end for screwing into a receptor thread to form screw connections on flanges, covers, closures and the like, especially for pressure vessels, reactor vessels or the like.

Screw connections of the kind described hereinbefore are frequently constructed so that the end face closure surface or a flange of a vessel or the like is provided with tapped holes disposed on a pitch circle, the leading or bottom end of screw bolts, both ends of which are provided with screw threading, being screw mounted into the said tapped holes. The bolts extend through corresponding apertures in the flange of a lid which is mounted on the vessel. Securing nuts are screw mounted on the screw threading of the projecting parts of the bolts thus producing the desired connection between the parts. Instead of being screw mounted in tapped holes in one of the parts which are to be connected, the screw bolts can also be screw mounted into other receptor screw threads, for example in nut members or the like.

In the case of such and similar connections there is frequently a demand to facilitate the screw mounting operations when the bolts are screw mounted into their receptor threads or when they are unscrewed therefrom. This applies particularly in the case of connections with relatively large dimensions in which the screw bolts themselves represent heavy parts which are not readily handled. Furthermore, increased difficulties arise when the bolts are unscrewed from their receptor bores by virtue of the fact that the bolts cannot be readily rotated and large forces are therefore required for detachment. Finally, there are cases in which the use of human labour is to be minimized both in terms of its amount as well as in terms of its duration. This applies to connections on parts or vessels, for example, those in hazardous rooms, the closures of reactor vessels and the like.

SUMMARY OF THE INVENTION

It is an object of the invention to provide a suitable device by means of which the aforementioned requirements can be satisfied to the largest possible extent. The invention also attempts to provide a particularly advantageous construction of a device for actuating the elements of screw connections.

The device according to the invention is characterized by a support member, the bottom end of which can be placed on a base, having at least one recess or aperture for the entry of at least one screw bolt end, and by at least one element which can be rotated by a rotatable drive, is retained by the support member or by a part connected thereto, and can be connected to the spanner flats of a screw bolt in torque-transmitting manner.

This provides apparatus by means of which screw bolts of the most diverse kinds and dimensions, more particularly including those of substantial weight, can be screw-mounted and unscrewed in suitable manner while avoiding manual work. The apparatus enables large forces to be applied, so that it is possible, for example, to unscrew those bolts which can be rotated only with difficulty.

The base on which the support member bears can be one of the parts which are to be connected, for example the flange of a lid which is to be mounted on the vessel. However, inter alia the base may also comprise a removable spacer or the like which is placed on such an aforementioned part.

Spanner flats include not only square ends, hexagons or the like but refer to all shapes which enable a torque to be transmitted by means of a spanner element, the previous remarks applying appropriately to the last-mentioned element. The spanner element is therefore adapted to the spanner flats on the bolt in such a way as to establish torque-transmitting engagement or disengagement.

The apparatus according to the invention may take the form of an individual unit for performing screwing operations on a single screw bolt. The apparatus can be constructed with special advantage so that it is able to screw or unscrew a plurality of screw bolts, the support member being adapted to accommodate a corresponding number of screw bolt ends, a corresponding number of spanner elements being also provided. More particularly a spanner element rotatable by motor means can be provided for each screw bolt associated with a screw connection which is to be established. In one embodiment of the device the support member for the simultaneus actuation of a plurality or of all screw bolts associated with the connection is appropriately an annular support frame which can be constructed integrally or in a plurality of parts.

A hydraulic motor or an electric motor, more particularly a geared motor, can be provided as a rotary drive for the spanner element. If a plurality of spanner elements are provided each of these can be associated with its own rotary drive. It is however also possible for a plurality of spanner elements to be rotated by means of suitable power transmitting elements, for example chains, from a rotary drive or to rotate groups of spanner elements from one rotary drive.

According to the invention a rotatable actuating element is provided for each spanner element, the acuating element having profiling which is adapted to engage in mating profiling on the exterior of the spanner element. This represnts a simple and very rugged construction. More particularly, the actuating elements can be hollow cylindrical parts which are supported on the support member or on a member associated therewith and being provided on their inside with the profiling adapted for engagement in the profiling of the spanner element. The rotating motion is transmitted to an actuating element, conveniently by means of a driving pinion which meshes with a gear rim of the actuating element.

According to a further feature of the invention the device is provided with means for retaining one or more screw bolts. It is then advantageously possible to move the screw bolt or bolts together with the device itself to the place of application and to transport it away with the apparatus after an unscrewing operation. The means for retaining the screw bolt or bolts can comprise a movable pin, finger or the like which engages in a recess of the screw bolt or grips under a shoulder thereof. Furthermore, jaws or the like which can be radially adjusted by means of a pressure medium drive can be provided for gripping the screw bolts. A nut, which bears on a support disposed below it in the apparatus and is screw mounted on screw threading of the bolt is particularly advantageous for retaining the latter.

A particularly advantageous and versatile embodiment of the apparatus according to the invention is also constructed as apparatus for clamping the screw bolts or forms part of such apparatus, at least one clamping unit adapted to act on the screw bolts being disposed in known manner on the support member, the said clamping unit containing at least one cylinder with a piston adapted to slide therein and to act on the screw bolt which is to be clamped or on an abutment member associated therewith.

In apparatus of this kind the means for retaining one or more screw bolts can comprise the abutment members of the clamping devices. A nut can be provided as abutment member.

In one suiable arrangement of the appropriate spanner element the latter is mounted on rise-and-fall retaining means. The spanner element can then be rapidly and simply engaged with or disengaged from the spanner flats of the bolt or other parts of the apparatus. A pressure medium cylinder can be used for raising and lowering the retaining means.

Pivotal retaining means for the spanner element are provided in a further embodiment of the invention. These retaining means enable the spanner element to be laterally pivoted if temporarily free passage is to be established through the apparatus. The pivotal retaining means can be combined with the rise-and-fall retaining means.

In an actuating device for elements of screw connections, more particularly of flanges, lids, closures and the like, especially in pressure vessels, reactor vessels or the like, with screw bolts which are adapted for screw mounting into receptor threads, more particularly in an apparatus having one or two of the previously explained features the invention provides for at least one lifting device for a screw bolt which is to be unscrewed or screw mounted, and lifting device being equipped with a lifting drive and being supportable on a base, either directly or through the retaining member which retains the device.

During the screwing operation such a lifting device is able to partially or wholly absorb the weight of the screw bolt, thus permitting a reduction of the torque for screwing and unscrewing the bolt. This represents an important advantage.

Advantageously the lifting device is provided with a pressure medium drive. This may also comprise one or more hydraulic cylinders or more particularly a compressed air cylinder. If the actuating device incorporates a rise and fall spanner element for rotating the bolt, the pressure medium cylinder will advantageously rise and lower the spanner element as well as raise the bolt itself.

The lifting device can be provided with elements which act directly on the screw bolt or a part associated therewith, for example the retaining nut which is screw mounted on the bolt.

According to a further feature of the invention the apparatus can also be associated with a coupling device to establish a power transmitting connection between the lifting device and the screw bolt. In this embodiment a locking element which can be slid into a recess or groove of the screw bolt can be provided for coupling the lifting device to the screw bolt. The locking element can bear on a base, for example a spanner for rotating the screw bolt. The locking element can be actuated manually or by means of a drive associated therewith, for example by means of a servo cylinder.

In one advantageous embodiment the lifting device is provided with a tension element which is disposed approximately in the extension of the screw bolt axis when the apparatus is in the operating position.

BRIEF DESCRIPTION OF THE DRAWINGS

Details, features and advantages of the invention will be explained hereinbelow by reference to embodiments which are illustrated in the accompanying drawing in which.

DETAILED DESCRIPTION OF ILLUSTRATED EMBODIMENTS

Figure 1:
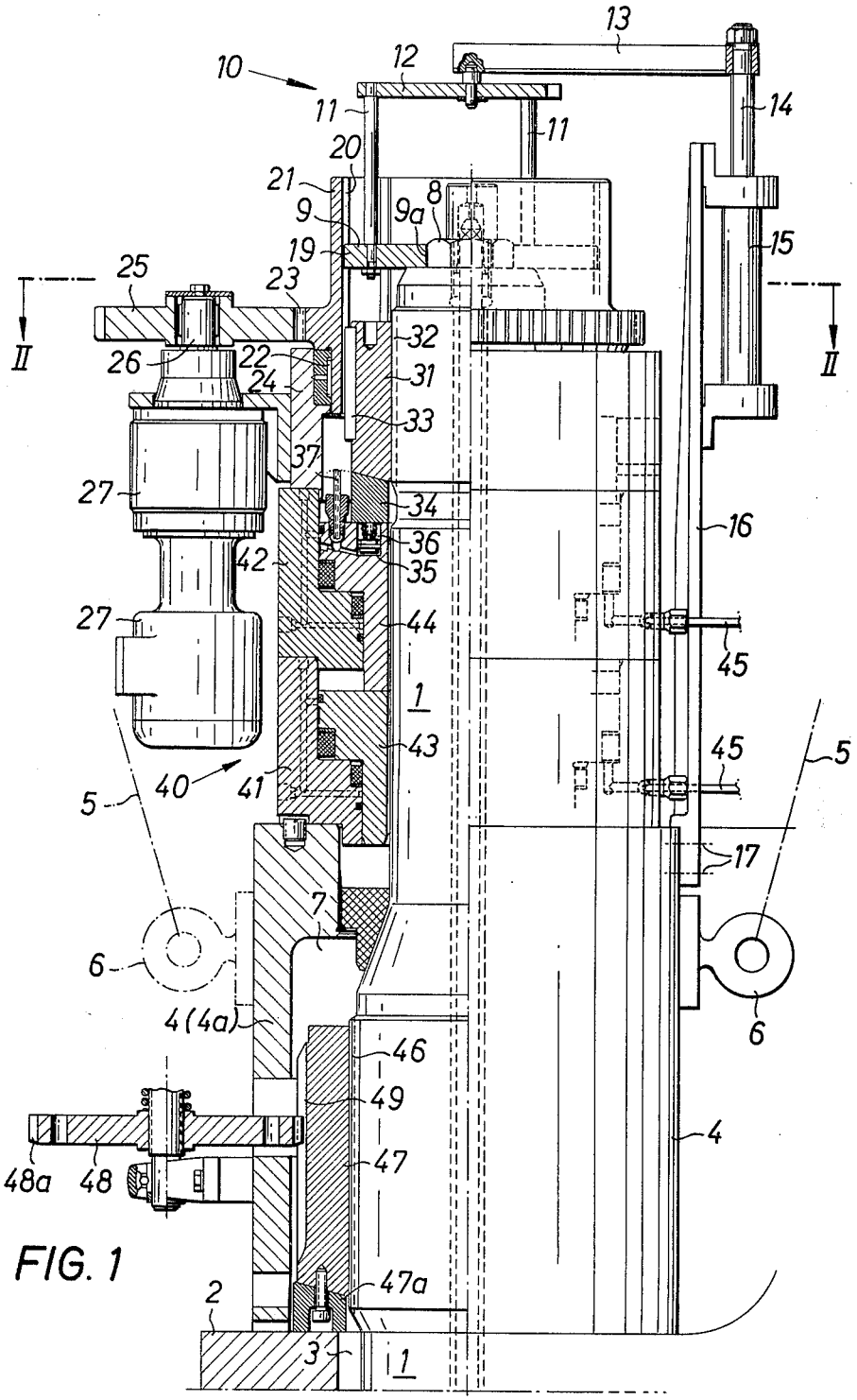
FIG. 1 shows a device according to the invention, partially as a side view and partially as a vertical median section.

The apparatus illustrated in FIG. 1 is provided for screwing and unscrewing, as well as for tightening, of a screw bolt 1 of the lid closure associated with a pressure vessel which is not shown. The drawing indicates merely the lid glange 2 through bores 3 the screw bolts 1 extend. The latter are screw mounted by means of screw threading at the bottom bolt end in the manner of screw studs into corresponding tapped holes which are provided in the closure flange, also not shown, of the pressure vessel which is to be closed by means of the lid. The bolts 1 are screwed into the receptor screw threads, and are also unscrewed therefrom if necessary, by means of the illustrated device.

Figure 2:
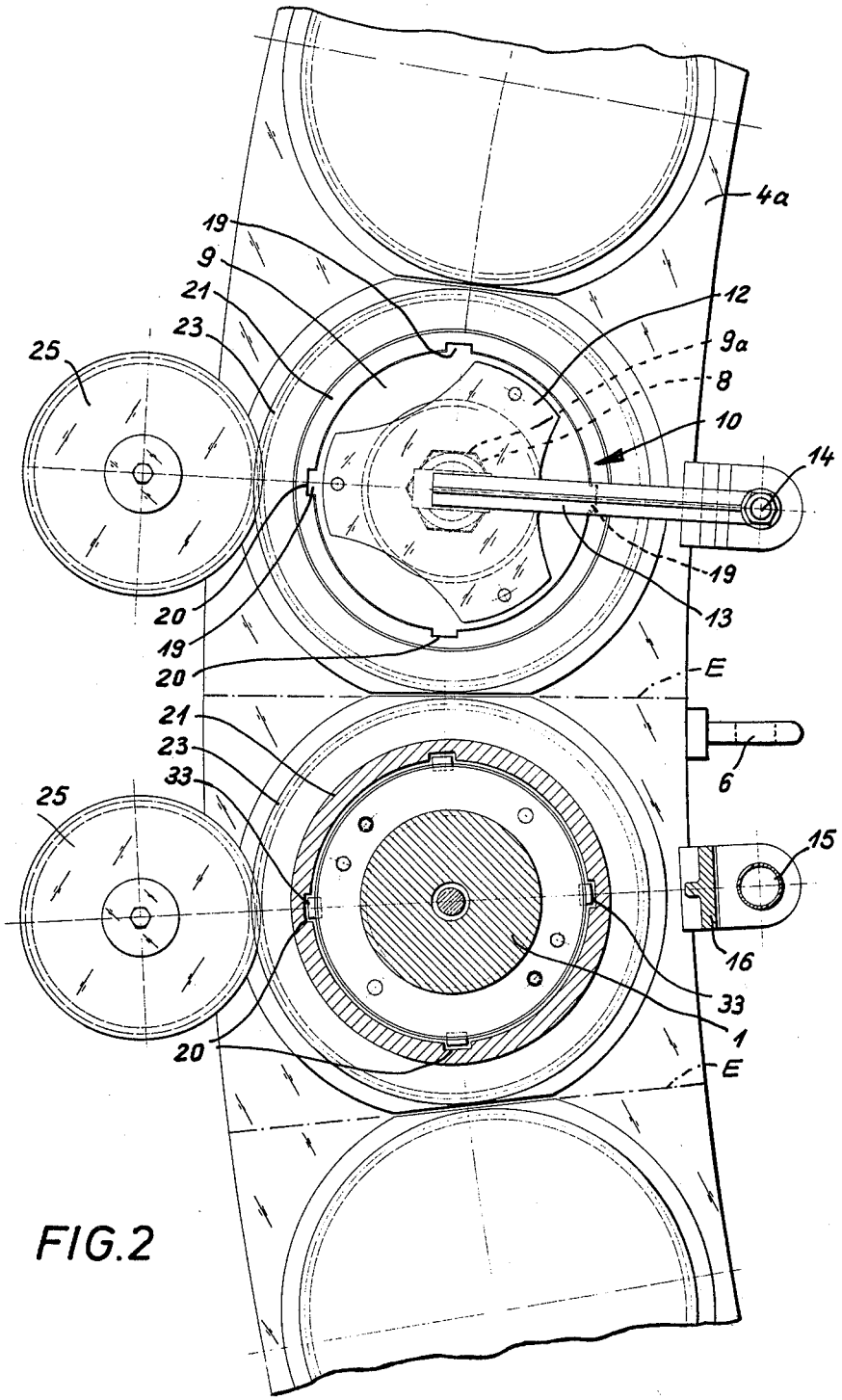
FIG. 2 is a plan view of part of the device with an annular support frame, a detail being shown in a horizontal section along the line II—II of FIG. 1.

The latter contains a support member 4 which can be placed on the top of the lid flange 2, for example by means of a crane, the apparatus being retained by chains 5, indicated by dash-dot line, and secured on eyelets 6. The device can be constructed as a unit for screwing only one bolt, in which case the support member 4 has a lateral limitation indicated by the dash-dot lines E of FIG. 2, (corresponding to the view of the right-hand half of FIG. 1), or it may have some other basic shape. As shown in FIG. 2, the apparatus is constructed so that it permits simultaneous scewing and unscrewing of a plurality or of all screw bolts 1 which are associated with a given connection. The shape of the support member is then adapted to the arrangement of the individual screw bolts in the connection, and more particularly is constructed as an annular support frame **4*a* if the screw bolts are situated on a pitch circle, FIG. 2 showing part of the said support frame. A support frame of this kind can be provided with actuating units, for example for 52 screw bolts. Eyelets 6 for tension elements for suspending the apparatus on a crane need be provided at only a few places on the inside of the support frame. Instead of the eyelet 6** it is possible to provide struts in a star pattern to connect the support frame to a middle suspension member on which a crane hook or some other tension element can act. In each case the entire device for rotating the screw bolts can be lowered from above on the appropriate lid flange and can be removed therefrom after use. Since the basic construction of the apparatus in both cases is identical in all other respects only one embodiment for the simultaneous rotation of a plurality of screw bolts will be described hereinbelow. These remarks will then apply appropriate to apparatus in the form of an individual unit.

A middle recess or opening 7 which permits the entry into the device of each bolt 1 which is to be actuated is provided in the support member 4 or support frame 4*a*. The top end of each screw bolt 1 is provided with spanner flats, for example in the form of a hexagon 8, which can be engaged with a plate-shaped element 9, having a middle hexagon aperture 9*a*, which functions as spanner for rotating the bolt. Each spanner element 9 is mounted on retaining means 10 comprising three rods 11, which are screw mounted to the element 9, a three-limbed head 12 which supports the rods 11 and an arm 13 from which the head 12 is rotatably suspended. One end of the arm 13 is mounted on the end of a piston rod 14 of a hydraulically or pneumatically actuated piston-cylinder unit 15 which is mounted on a bracket 6. The last-mentioned bracket is bolted at the position 17 on the support 4 or 4*a*. The spanner element can be lowered or raised and therefore can be engaged with or disengaged from the spanner flats 8 or the bolt 1 by means of the unit 15 whose pressure medium inlet and outlet, not shown, extends to a control valve. The arm 13 can be rotatably supported on the piston rod 14, so that it can be pivioted to one side when the spanner element 9 is raised, in order to provide complete free access to the aperture of the apparatus when necessary.

On its external circumference the spanner element 9 is provided with four projections 19 by means of which it engages into four slot-like recesses 20 of a hollow cylindrical actuating element 21 when the said spanner element is in the operating position. The actuating element is rotatably supported by means of a rolling bearing 22 in a cylindrical wall part 24 of the device, and is provided with an external gear ring 23 into which a driving pinion 25 engages. The pinion 25 is mounted on the output shaft 26 of a motor drive 27 which is mounted on the wall part 24 and whose direction of rotation is reversible. The said motor drive may comprise, for example, a hydraulic motor with a step-down transmission disposed on its output side. The screw bolt 1 is rotated in its receptor screw thread via the actuating element 21 and the spanner element 9 for the purpose of screwing or unscrewing by means of the aforementioned drive. FIG. 2 discloses only two driving pinions 25 which engage in the gear rims 23 of actuating elements 21. All actuating elements can be provided with their own drive. The energy supply ducts extending to the drives and control elements for the latter can be of known kinds and construction and are not separately shown.

The apparatus also contains means for retaining the screw bolts 1. In the illustrated embodiment said means comprise a nut 31 which is screw mounted on screw threading 32 which is situated below the spanner flats 8 of the bolt 1, said nut being in engagement through shaft keys 33 with the slot recesses 20 of the actuating element 21 so as to be rotated together therewith, said nut bearing via a one-sided conical ring 34 associated therewith on a part 44 which is associated with the device. The bolt 1 is retained in the device even when the bolt is unscrewed, namely due to the screw threaded engagement with the support nut 31.

In the illustrated embodiment the screwing and unscrewing device for the screw bolts 1 also functions as a clamping device for the bolts 1. To this end a clamping unit 40 is associated with each of the bolts in question, said clamping units in the illustrated embodiment comprising two superjacent cylinders 41 and 42, in which stepped pistons 43 and 44 can slide, said pistons being connected to the support member 4, for example by means of screw fasteners. The bottom of the top piston 44 bears on the top of the bottom piston 43. In order to obtain motion of the pistons 43, 44, pressure medium can be supplied to the two cylinders 41 and 42 through ducts 45 which are connected to common supply ducts for all clamping units, for example through a stop valve. By comparison to a single piston, the use of two superjacent pistons offers the advantage that the surface on which the pressure medium is to act is twice as large and therefore it is possible for twice the force to be applied for a given feed pressure without calling for a greater width of construction.

The above-mentioned piston relates to the previously-mentioned part 44 which provides the support for the nut 31 with the ring 34. In cooperation with the piston 44, the nut 31 functions as an abutment member and in operation of the clamping units 40 it transmits the force exerted by the piston in the form of a tensile force to the screw mounted bolt 1 for the purpose of prestressing the latter in known manner. In order to establish the connection with the bolts in the prestressed state, a nut 47 engaged with the mounting screw threading 46 on the bolt 1 is tightened so that the intermediate member 47*a* disposed on the said nut bears on the top of the lid flange 2 (FIG. 1).

Rotation of the mounting nuts 47 required to this end can be obtained by means of an actuating pinion 48, the teeth 48*a* of which mesh with corresponding external teeth 49 of the mounting nut 47. The actuating pinions 48 can be rotated by means of a motorized individual or group drive not shown or, where appropriate, manually with a suitable power transmission element.

If an established connection is to be released, the apparatus is mounted so that the spanner elements 9 engage with the spanner flats 8 on the bolts 1 by being lowered. The mounting nut 47 need then be rotated only by a small amount, for example 180°. In the case of prestressed bolts the clamping unit 40 first biases the pistons 43, 44 hydraulically in order to rotate the bolts sufficiently to release the contact pressure by means of which the nut 47 bears against the lid flange 2. The hydraulic pressure is removed after the nut 47 is released. The bolt 1 is then rotated by the drive 27 through the spanner element 9 and is thus detached from its receptor screw thread. If necessary this operation can proceed in several steps, the device being raised and, where appropriate, supported in each case by a corresponding amount. A safety device against rotation, adapted to act on the lid flange 2, can be provided when necessary in the case of an individual unit to absorb a counter torque. After the bolt 1 is completely released the device can be removed in its entirety, the bolts 1 being retained in the said device by the nuts 31 which bear on the pistons 44 so that the said bolts are removed together with the device. The device together with the bolts is moved into position and the bolts are screwed in by corresponding reverse procedure.

The cylinders 41, 42 and the pistons 43, 44 are omitted in a device which is not also equipped with a clamping device or is combined therewith, so that the wall part 24 which supports the motor drive 27 and the bearing system 22 for the actuating element 21 is not fixedly connected to the cylinder 42, as in the illustrated embodiment, but is connected to the support member 4 or 4*a* either directly or through an intermediate member in which case the last-mentioned support member can also have a different shape or a different height. If a nut 31 is also provided for retaining the affected bolt 1 the support for the nut can be formed by a part corresponding to the piston 44, for example a shoulder on the support member or an element associated therewith.

The two cylinders 35 (of which only one is shown in FIG. 1) in which small thrust pistons 36 are adapted to slide are provided at two diammetrically opposite positions in the piston 44 (or on a part replacing the said piston in an embodiment without a clamping unit). Pressure medium can be supplied through a valve from a source not shown via a supply duct 37 to the cylinders 35 so that the pistons 36 tend to move outwardly while exerting a lifting force on the ring 34 with a nut 31. This represents a lifting device by means of which the weight of the appropriate bolt can be at least partially absorbed during the screwing or unscrewing operation, thus reducing the friction in the screw threads of the receptor screw threading for the bolt, and therefore also reducing the torque which has to be supplied by the drive 27 for rotating the bolt.

Figure 4:
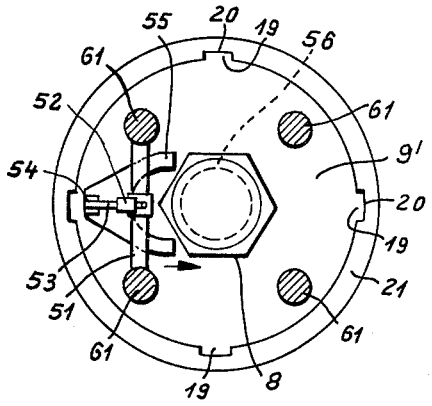
FIG. 4 is a section along the line IV—IV of FIG. 3.
Figure 3:
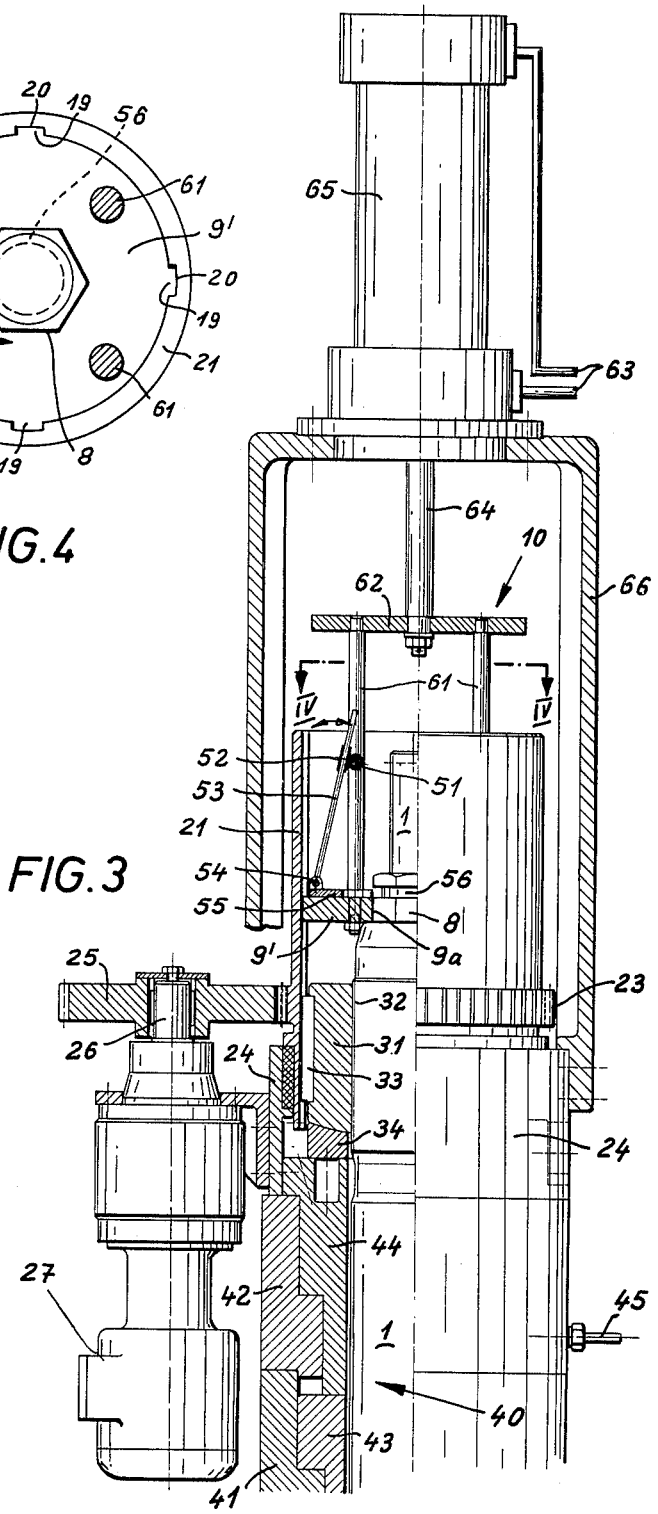
FIG. 3 shows the upper part of another embodiment of the actuating device, partially as a side view and partially as a vertical median section.

In the further embodiment shown in FIGS. 3 and 4, a retaining superstructure 66 is mounted on a support member or support frame or parts 24 associated therewith, which can be mounted on a base, for example a lid flange, said retaining superstructure supporting a double-acting pneumatic cylinder 65 with a piston, not shown, which is slidable therein and whose piston rod 64 is in flush alignment with the axis of the screw threaded bolt 1 in the illustrated operating position of the device. Compressed air can be supplied to the cylinder 65 through a control valve and ducts 63 so that one or the other piston side can be optionally biased for moving the piston rod 64 either upwardly or downwardly. A head 62 is rotatably retained at the bottom end of the piston rod 64 and four downwardly orientated rods 61 are fixedly joined to the said head. The rods support a plate 9' which functions as a spanner and has a middle hexagonal aperture 9*a* which can be engaged with a hexagon 8 on the screw bolt 1 in a manner similar to that already explained in connection with the embodiment of FIGS. 1 and 2. In this case the spanner 9' can also be rotated by means of a drive 27 via an actuating element 21 for screwing or unscrewing the bolt 1 in one or the other direction. Parts which correspond to those of the embodiment according to FIGS. 1 and 2 have the same reference numerals and the explanation of the method of operation of corresponding elements of the embodiment according to FIGS. 1 and 2 also apply in this case.

A cross-member 51, on which a tubular sliding guide 52 for an operating lever 53 is rotatably supported, extends between two rods 61. The bottom end of the actuating lever 53 is connected through a joint 54 to a bifurcated locking element 55 which bears on the spanner 9'. By pivoting the actuating lever 53 in the sense of the arrow shown in FIG. 3 the locking element 55 can be moved from the illustrated position into a coupling position in which it engages with an annular groove 56 in the bolt 1. The lifting device comprising the pneumatic cylinders 65 and the parts associated therewith is thus coupled to the bolt 1 so that by biasing the piston in the cyclinder 65 with compressed air it is possible to apply an upwardly orientated force onto the bolt 1 by means of the piston rod 64, which in this case acts as a tension element, the said force counteracting the dead weight of the bolt 1. The friction in the screw threads of the receptor screw threading for the bolt can thus be substantially reduced and screwing or unscrewing the bolt and the torque to be applied to the bolt during the screwing operation can also be reduced.

Although the lifting devices described above can be particularly advantageously employed together with motor driven rotating devices for screw bolts, they can also be advantageously employed for screwing operations performed in some other manner, even if the screwing operation itself is manually performed.

Furthermore in the embodiment illustrated in FIG. 3, the bottom part, which is not shown, can be constructed identically with or similar to the part according to FIG. 1, so that the explanations given above also apply to the device according to FIG. 3.

While preferred forms of the invention have been shown and described, it will be understood that various modifications may be made within the spirit and scope of the invention which should be limited only by the appended claims.

I claim:

1. Device for tensioning screw bolts, which can be screwed into a receptor screw threading and on to which fastening nuts can be screwed to form screw connections on flanges, lids, closures and the like, especially in pressure vessels, reactor vessels or the like, the device including a support member the bottom end of which can be placed on a base, said support member having at least one opening for receiving at least one screw bolt end and having at least one cylinder with a piston slidable within the latter, which piston is adapted to act on an abutment nut, the device being further provided with motor means for rotating the said abutment nut, so as to screw or unscrew the latter on to or from the screw bolt, wherein the said motor means for rotating the abutment nut serves further as a motor drive for a spanner element provided on the support member or on a part associated therewith, said spanner element being movable to be brought into and out of torque-transmitting connection with spanner flats of the screw bolt and being adapted to be rotated by said motor means for screwing the screw bolt into or out of the said receptor screw threading.

2. Device according to claim 1, wherein a rotatable actuating element is supported on the support member or on a part associated therewith, the actuating element being provided on its outer periphery with a gear into which a driving pinion of the motor means engages, the actuating element on its inner side and said spanner element on its periphery being provided with engaging means in form of mating profiles adapted for transmitting a rotary motion of the actuating element to the spanner element and adapted to allow an axial shifting motion of the spanner element relatively to the actuating element.

3. Device according to claim 1, wherein means are provided for retaining at least one screw bolt in the said opening of the support member.

4. Device according to claim 1, wherein the spanner element is held by a mounting being adapted to be raised and lowered by means mounted on the supporting member or on a part associated therewith.

5. Device according to claim 4, wherein said means for raising and lowering the mounting of the spanner element include a piston-cylinder unit.

6. Device according to claim 1, wherein the spanner element is held by a mounting adapted to be swung transversely to said receiving opening for the screw bolt in and out of alignment with the screw bolt.

7. Device according to claim 1, wherein a spanner element which can be rotated by motor means is provided on the support member for each of the screw threaded bolts associated with a screwed connection which is to be established and a separate rotary drive is provided on the support member for each spanner element.

8. Device according to claim 1 wherein the support member comprises an annular support frame.

9. Device for tensioning screw bolts, which can be screwed into a receptor screw threading and onto which fastening nuts can be screwed to form screw connections on flanges, lids, closures and the like, especially in pressure vessels, reactor vessels or the like, the device including a support member the bottom end of which can be placed on a base, said support member having at least one opening for receiving at least one screw bolt end and having at least one cylinder with a piston slidable within the latter, which piston is adapted to act on an abutment nut, wherein a spanner element is provided on the support member or on a part associated therewith, said spanner element being movable to be brought into and out of torque-transmitting connection with spanner flats of the screw bolt and being adapted to be rotated for screwing the screw bolt into or out of the said receptor screw threading, and wherein a lifting device having power-operated means is provided on the support member or on a part associated therewith, said lifting device includes coupling means for establishing a power-transmitting connection between the lifting device and the screw bolt.

10. Device according to claim 9, wherein the power-operated means includes a pressure medium actuated cylinder-piston unit.

11. Device according to claim 9, wherein said coupling means includes a locking element which can be shifted to engage into a recess or groove of the screw bolt.

12. Device according to claim 11, wherein the locking element bears on the said spanner element for rotating the screw bolt.

13. Device according to claim 9, wherein the lifting device is provided with a pull element which is approximately in alignment with the axis of the screw bolt when said lifting device is in the operating position.

14. Device according to claim 9, wherein a motor means for rotating the abutment nut serves further as a motor drive for said spanner element.

* * * * *